US006892638B2

(12) United States Patent
Sculler

(10) Patent No.: US 6,892,638 B2
(45) Date of Patent: May 17, 2005

(54) HAND STAMP AND LOCKING STORAGE CAP

(75) Inventor: Steven J. Sculler, Morganville, NJ (US)

(73) Assignee: M&R Marking Systems, Inc., Piscataway, NJ (US)

( * ) Notice: Subject to any disclaimer, the term of this patent is extended or adjusted under 35 U.S.C. 154(b) by 0 days.

(21) Appl. No.: 10/749,438

(22) Filed: Dec. 31, 2003

(65) Prior Publication Data

US 2004/0250719 A1 Dec. 16, 2004

Related U.S. Application Data

(60) Provisional application No. 60/437,660, filed on Jan. 2, 2003.

(51) Int. Cl.[7] ..... B41K 1/40; B41K 1/56

(52) U.S. Cl. ..... 101/333; 101/327; 101/405

(58) Field of Search ..... 101/103, 104, 101/105, 327, 333, 334, 405, 406

(56) References Cited

U.S. PATENT DOCUMENTS

| | | | | |
|---|---|---|---|---|
| 3,988,987 | A | 11/1976 | Ikura et al. | |
| 4,289,070 | A | 9/1981 | MacGregor | |
| 4,625,640 | A | 12/1986 | Bunger | |
| 4,852,489 | A | 8/1989 | Wall et al. | |
| 5,277,721 | A | 1/1994 | Ooms | |
| 5,377,599 | A | 1/1995 | Wall et al. | |
| 5,471,930 | A | 12/1995 | Wood | |
| 5,505,130 | A | 4/1996 | Winston | |
| 5,517,916 | A | 5/1996 | Dour et al. | |
| 5,531,829 | A | 7/1996 | Yasoshima | |
| 5,577,444 | A | 11/1996 | Toyama | |
| 5,586,500 | A | 12/1996 | Takami et al. | |
| 5,601,644 | A | 2/1997 | Yasoshima | |
| 5,611,984 | A | 3/1997 | Sculler et al. | |
| 5,636,569 | A | 6/1997 | Winston | |
| 5,649,485 | A | 7/1997 | Dour et al. | |
| 5,653,804 | A | 8/1997 | Yasoshima | |
| 5,655,451 | A | 8/1997 | Wasylczuk et al. | |
| 5,727,467 | A | 3/1998 | Skopek | |
| 5,768,992 | A | 6/1998 | Daw et al. | |
| 5,865,892 | A | 2/1999 | Yasoshima | |
| 5,870,953 | A | 2/1999 | Winston | |
| 6,000,335 | A | 12/1999 | Imamaki et al. | |
| 6,007,751 | A | 12/1999 | Sculler et al. | |
| 6,047,639 | A | 4/2000 | Shih | |
| 6,058,840 | A | 5/2000 | Poplawski et al. | |
| 6,067,905 | A | 5/2000 | Faber | |
| 6,119,596 | A | 9/2000 | Fletcher et al. | |
| 6,289,806 | B2 | 9/2001 | Hirano | |
| 6,348,168 | B1 | 2/2002 | Lowrance et al. | |
| 6,499,398 | B2 | 12/2002 | MacNeil | |
| 6,500,601 | B1 | 12/2002 | Sculler et al. | |
| D478,930 | S | 8/2003 | Zambelli et al. | |
| 6,843,173 | B2 * | 1/2005 | Shih | 101/111 |
| 2003/0150343 | A1 | 8/2003 | Koneczny | |

FOREIGN PATENT DOCUMENTS

| | | | | |
|---|---|---|---|---|
| JP | 60-162684 | * | 8/1985 | 101/327 |

OTHER PUBLICATIONS

International Search Report, mailing date Jun. 16, 2004.

* cited by examiner

*Primary Examiner*—Leslie J. Evanisko
(74) *Attorney, Agent, or Firm*—Lerner, David, Littenberg, Krumholz & Mentlik, LLP

(57) ABSTRACT

A hand stamp assembly including a hand stamp and associated storage cover is disclosed. The storage cover is operatively associated with the hand stamp and facilitates locking of the hand stamp in a compressed position within the storage cover.

10 Claims, 4 Drawing Sheets

HAND STAMP AND LOCKING STORAGE CAP

CROSS-REFERENCE TO RELATED APPLICATION

This application claims the benefit of U.S. provisional application No. 60/437,660 filed on Jan. 2, 2003.

BACKGROUND OF THE INVENTION

This invention relates generally to stamping devices useful for making ink impressions on papers such as documents, envelopes and the like and on other surfaces such as plastic and cardboard containers. More particularly, this invention relates to a hand-held self-inking stamp having a releasable locking assembly including a removable storage cover which enables the self-inking stamp to be compressed and locked in the compressed position until it is needed for use.

Pre-inked and self-inking hand stamps are well known in the art. For example, M&R Marking Systems, Inc. of Piscataway, N.J. manufactures and sells high quality pre-inked and self-inking hand stamps under the well known trademarks ROYAL MARK, IDEAL, OPTIMARK and ULTIMARK.

Pre-inked marking structures may be made from ROYAL MARK brand gel, which comprises a mixture of thermoplastic resin and ink. This mixture is also known as pre-mix used for manufacturing microporous marking structures.

Other pre-ink marking structures are made from ULTIMARK foam or OPTIMARK laser foam, which are also microporous marking structures. The ULTIMARK and OPTIMARK foam products are impregnated with ink to be used with pre-inked hand stamps.

The IDEAL brand self-inking hand stamps include a frame and a casing (i.e., operating member) slidably mounted on the frame. A platen is mounted on the operating member. A rubber marking structure is secured to one surface of the platen. An ink pad is arranged on the frame for supplying ink to the face of the rubber marking structure. A spring is arranged between the casing and the frame for urging the casing upward into its rest position, where the rubber marking structure on the platen is in contact with the ink pad. The rest position may also be considered an uncompressed or non-stamping position.

When a user desires to create an ink imprint, the casing must be pushed downwardly, causing the spring to compress. The platen carrying the rubber marking structure follows the casing and thus moves away from the ink pad. Downward movement of the casing and the rubber marking structure continues as the platen interacts with a turnover mechanism arranged on the frame. This interaction causes the platen and the rubber marking structure thereon to turn over as they continue to move downwardly. The downward movement continues until the face of the rubber marking structure contacts an object to be marked (typically a piece of paper or the like).

Various prior art patents, which disclose features of self-inking hand stamps, include U.S. Pat. Nos. 5,517,916; 5,649,485; 4,852,489; and 4,432,281.

Prior art IDEAL, ROYAL MARK, OPTIMARK and ULTIMARK hand stamps and the foregoing patents do not disclose storage covers having the features of the present invention. Storage covers are known for use with self-inking and pre-inked hand stamps in order to prevent dust from settling on the marking surface of the hand stamps and to prevent ink from coming in contact with the marking surfaces due to inadvertent depression of the hand stamps.

It is also known for self-inking hand stamps to have locking features where the hand stamps can be locked in compressed or partially compressed positions. Such locking features are sometimes used during re-inking of self-inking hand stamps. One problem that exists with hand stamps having known locking features is that the locking features are cumbersome and often require the user to use both hands when placing the hand stamp into a locked position.

Further, it is known to place the hand stamp on or within a storage cover after the hand stamp has been compressed into a locking position. This arrangement has the benefit of reducing the size of the hand stamp so that it can be more readily transported or stored. However, there is no known storage cover, which interacts with the hand stamp casing to lock it into a compressed, or partially compressed, position.

The present invention overcomes these problems by providing an improved self-inking hand stamp assembly including a storage cover, which is operatively associated with a coacting locking feature of a hand stamp.

SUMMARY OF THE INVENTION

One aspect of the present invention is to provide a hand stamp assembly comprising a hand stamp and a storage cover where the hand stamp is operatively associated with the storage cover such that when the hand stamp is placed in the storage cover and subsequently compressed, the storage cover interacts with a locking feature of the hand stamp whereby the hand stamp is placed in a locked position. The hand stamp can easily be taken out of its locked position and returned to its uncompressed operating position.

Another aspect of the present invention provides a hand stamp and an operatively associated storage cover where the hand stamp and the storage cover interact to place the hand stamp in a compressed and locked position in a single action. When the hand stamp is removed from the storage cover, it can remain in a locked position. The hand stamp can subsequently be taken out of its locked position and returned to its uncompressed operating position.

It is another aspect of the present invention to provide a hand stamp assembly including locking features actuated by a coacting removable storage cover to enable the storage cover to releasably lock the operating member (i.e., casing) in compressed relation to a frame on which it is slidably mounted to minimize the size of the hand stamp assembly.

It is another aspect of the present invention to provide a self-inking hand stamp assembly, which can be readily locked in one of several compressed positions, and placed back into its unlocked rest position The above-mentioned and other objects, features and advantages of the present invention will be better appreciated with reference to the accompanying drawings and the detailed description of the illustrated embodiment of the invention

DETAILED DESCRIPTION

Figure 1:
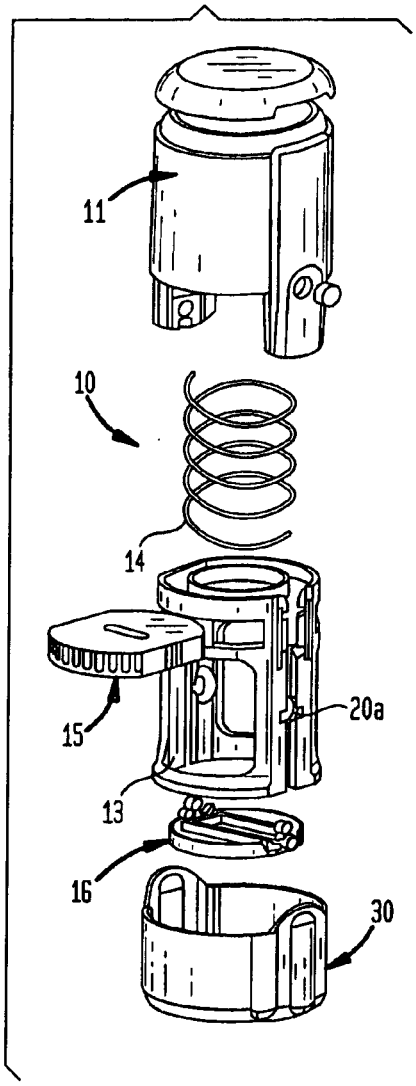
FIG. 1 is an exploded perspective view showing the elements of a self-inking hand stamp assembly in accordance with the present invention.
Figure 2:
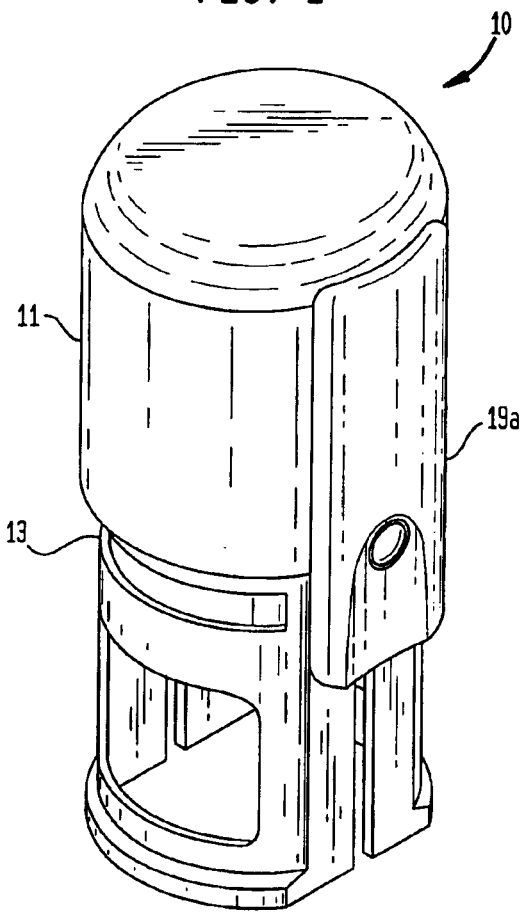
FIG. 2 is a perspective view of the hand stamp shown in FIG. 1 in a rest position.
Figure 3:
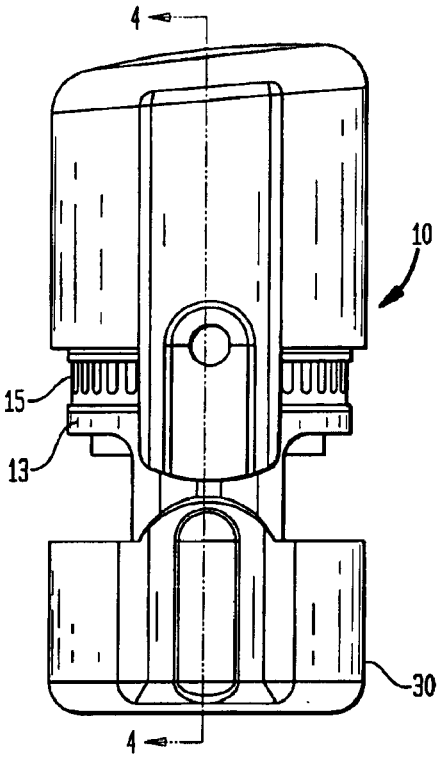
FIG. 3 is a side view showing the hand stamp assembly in accordance with the present invention in a rest position within a storage cover.

Referring to the drawings, FIG. 1 shows an exploded view of one embodiment of a self-inking hand stamp assembly generally designated 10, in accordance with the present invention.

While the present invention is being illustrated utilizing a self-inking hand stamp, it should be appreciated that it covers other stamping devices, such as pre-inked hand stamps where the operating member is slidably mounted on a frame.

Self-inking hand stamp assembly 10 has a frame 13 and an operating member 11 slidably mounted on the frame 13. The operating member 11 has an internal wall defining a casing 12. A spring 14 is disposed in the casing 12 between the operating member 11 and the frame 13 so that the operating member 11 can move from a rest position to a fully compressed stamping position and vice versa.

The frame 13 has an ink pad 15 and a platen 16 with a marking structure 23 (e.g., rubber impression member) having indicia thereon secured to one face 17 of the platen 16. The platen 16 is mounted in the frame 13 for inverted movement to enable marking structure 23 to engage the ink pad 15 when the operating handle moves the platen 16 to the rest position (i.e., when the hand stamp is uncompressed) and to stamp the indicia on the platen face 17 onto the surface to be imprinted when the platen 16 is moved to the stamping position (i.e., when the hand stamp is fully compressed).

The present invention provides a mechanism, which enables the hand stamp assembly 10 to be disposed in one of several partially compressed positions until it is desired to release it to an uncompressed rest position. This mechanism is accomplished by a releasable locking mechanism generally designated 18 including opposite disposed locking tabs as at 19*a* and 19*b*, which are slidably mounted in openings as at 20*a* and 20*b* on the guide rails 21*a* and 21*b* at opposite sides of the wall of casing 12 formed by the operating member 11, which is slidably mounted on the frame 13, all of which is shown in FIGS. 1, 2, 4, 9, 10 and 11.

Figure 4:
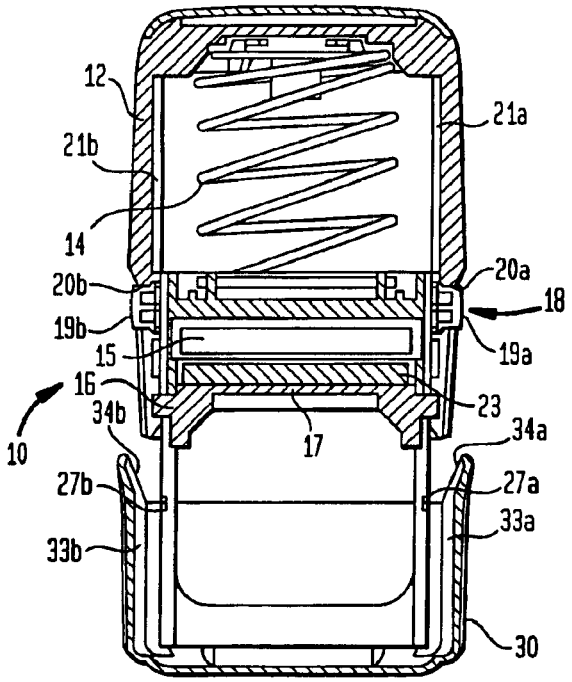
FIG. 4 is a cross-section taken on line 4—4 of FIG. 3 showing a locking button in a disengaged position.
Figure 5:
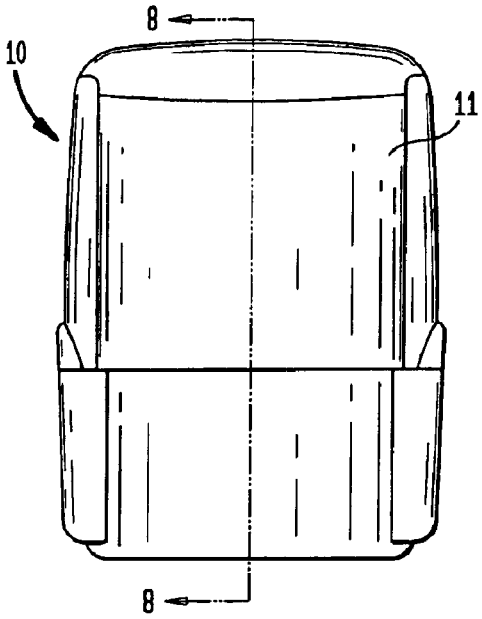
FIG. 5 is a front view of the hand stamp in a compressed and locked position within the storage cover.
Figure 6:
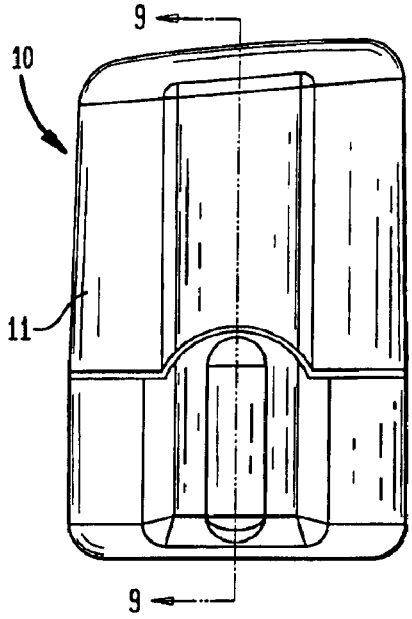
FIG. 6 is a side view of the hand stamp assembly shown in FIG. 5.
Figure 7:
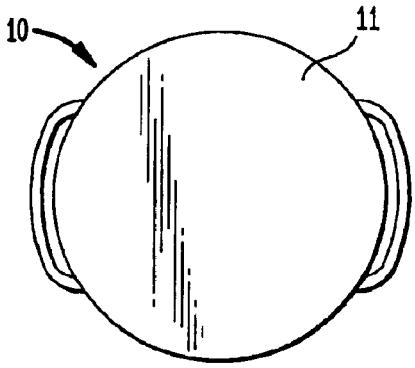
FIG. 7 is a top plan view of the hand stamp assembly shown in FIGS. 5 and 6.
Figure 8:
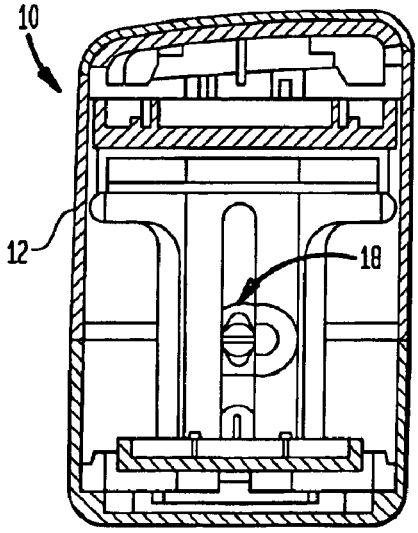
FIG. 8 is a longitudinal cross-section taken on line 8—8 of FIG. 5.
Figure 9:
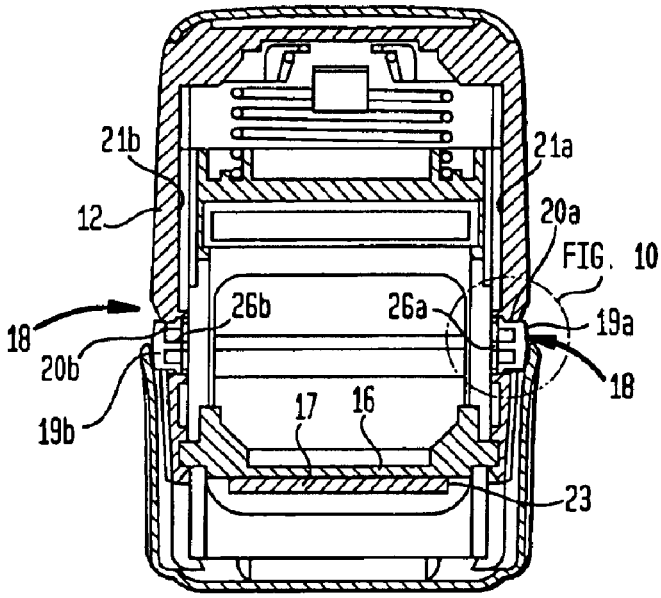
FIG. 9 is an enlarged cross-section taken on line 9—9 of FIG. 6.
Figure 11:
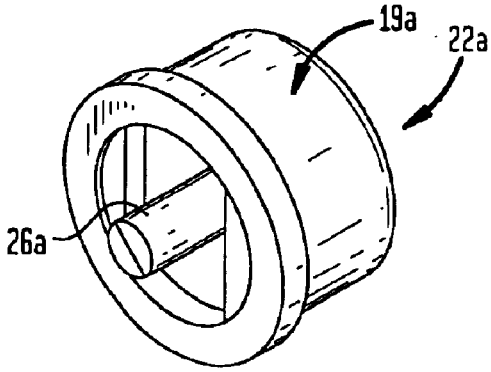
FIG. 11 is an enlarged perspective view of the locking button shown in FIGS. 1, 9 and 10 of the drawings.

The locking tabs 19*a* and 19*b* are generally cylindrical members. For purposes of illustration, only one locking tab 19*a* is shown at FIG. 11. However, locking tab 19*b* is identical to locking tab 19*a* but disposed on the opposite side of the self-inking hand stamp assembly 10 as is shown at FIGS. 4 and 9. While two locking tabs 19*a* and 19*b* are shown, those skilled in the art will recognize that only one tab may be necessary to establish the desired locking of the operating member 11 to the frame 13 without departing from the scope of the present invention. Locking tabs 19*a* and 19*b* may be rounded on the exterior face as at 22*a* to facilitate the operative relation with the storage cover 30 for the hand stamp assembly 10, as hereinafter more fully described.

It should be appreciated locking tabs 19*a* and 19*b* may have various geometric shapes within the scope of the invention. Whatever the shape may be, in a preferred embodiment at least one of the locking tabs 19*a* or 19*b* is arranged on the side of the operating member 11 to permit interaction with portions of the storage cover 30 as discussed below. In alternate embodiments, the locking tabs 19*a* and 19*b* may be recessed within the respective side walls of the operating member.

Frame 13 is provided with several latch receiving openings (i.e., locking cut-outs) 27*a* on opposite sides of the frame 13 at a position such that it will not interfere with the normal sliding movement of the operating member 11 along the frame 13. By pushing down on operating member 11, the spring 14 becomes compressed and the operating member 11 is thus forced to slide downwardly along the slots (unnumbered) within the frame 13. When the operating member 11 moves to a desired location, the latch receiving openings 27*a* and 27*b* in the frame become so aligned with the respective latch members 26*a* and 26*b* that user can urge the latch members 26*a* and 26*b* into engagement with the latch receiving openings 27*a* and 27*b*. Thus, the operating member 11 will be releasably locked in a selected one of several partially compressed positions, or a fully compressed position, with respect to the frame 13, as shown in FIGS. 1, 4, 9 and 10.

Figure 10:
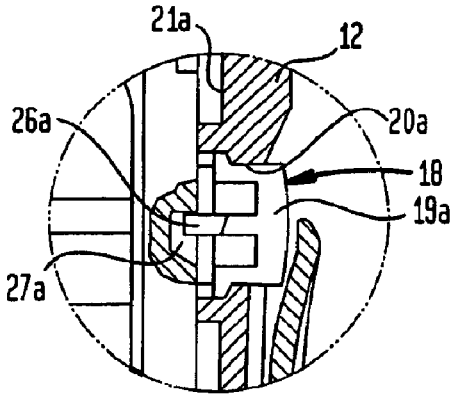
FIG. 10 is an enlarged view of the circled portion A on FIG. 9.

FIGS. 9 and 10 further show that to lock the operating member 11 to the frame 13 in this partially compressed position, a storage cover 30 is provided, which operatively engages the locking tabs 19*a* and 19*b* of the self-inking hand stamp 10. The storage cover 30 is thus operatively associated with the hand stamp 10 as it interacts with locking tabs 19*a* and 19*b* of the operating member 11 to lock the hand stamp 10 in one of several substantially compressed positions while retaining closure of the open bottom end of the frame 13. In this locked position, ink from the marking structure 17 on the platen 16 cannot accidentally become imprinted on any surrounding surface with which it may come into contact.

The storage cover 30 may include a generally annular portions having an inner walls defining a storage cavity. Formed on the inner walls of the annular portions at opposite sides thereof are longitudinally extending raised ribs 33*a* and 33*b*. The raised longitudinal ribs 33*a* and 33*b* extend above the upper end of the annular portions of the storage cover 30 and fan outward to form actuating shoulders at 34*a* and 34*b*, so that when the operating member 11 is brought into engagement with the storage cover 30, the actuating shoulders 34*a* and 34*b* will engage the outer or exterior faces of the respective locking buttons or locking tabs 19*a* and 19*b* and force each of them inwardly toward the frame 13 until the projecting latch members 26*a* and 26*b* of the locking tabs 19*a* and 19*b* fall into alignment with and are moved into latch receiving opening 27*a* and 27*b* to lock the operating member 11 on the frame 13 in a desired substantially compressed position.

In a preferred embodiment, the storage cover 30 has an interior cavity that is sized and shaped for frictional engagement with the frame 13 or operating member 11. The frictional relationship between the storage cover 30 and the frame 13 or operating member 11 of the hand stamp 10 may be accomplished in various ways. For example, the operating member 11 may have projections along one or both sides thereof, which abut the longitudally extending ribs 33*a* and 33*b* within the cavity of the storage cover 30.

When the storage cover 30 is removed, the hand stamp assembly 10 can be placed back into normal operation by pressing down on the operating member 11. This forces the operating member 11 against the spring 14 and brings the respective beveled faces on the latch receiving openings 27*a* and 27*b* within the frame 13 into engagement with the inner end of the latch members 26*a* and 26*b* to release the locking tabs 19*a* and 19*b* from locking engagement. This allows spring 14 to return operating member 11 to the normal rest position (i.e., fully uncompressed position) shown in FIG. 2.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A hand stamp assembly comprising:

a. a frame having at least one locking cut-out therein;

b. an operating member slidably mounted on the frame;

c. a platen mounted on the operating member;

d. an impression member secured to the platen, the impression member having indicia formed thereon to be stamped during use of the hand stamp assembly;

e. a spring disposed between the operating member and the frame to normally maintain the operating member in an expanded non-stamping position;

f. a locking assembly including at least one locking tab arranged on the operating member and disposed for releasable engagement with the frame to hold the operating member in a compressed position; and g. a storage cover in which the frame is placed, disposed to engage the at least one locking tab and to push the at least one locking tab into the at least one cut-out of the frame thereby locking the operating member in a compressed position with respect to the frame upon depression of the operating member.

2. The hand stamp assembly of claim 1, further comprising means for releasing the operating member from engagement with the frame.

3. The hand stamp assembly of claim 2 where the locking cut-out of the frame includes a lower beveled face where the locking tab engages the locking cut-out to lock the operating member in the compressed position, and the beveled face of the locking cut-out can release the locking assembly when the storage cover is removed.

4. The hand stamp assembly of claim 1, wherein the locking assembly further comprises an opening in the operating member, the at least one locking tab extending through the opening, the locking member slidably disposed in the opening of the operating member for releasable locking engagement with the frame.

5. A hand stamp assembly comprising:

a. a frame;

b. an operating member slidably mounted on the frame and having a locking tab arranged thereon disposed for releasable engagement with the frame; and c. a storage cover in which the frame is placed disposed to force the locking tab into engagement with the frame thereby locking the operating member in a compressed position with respect to the frame upon depression of the operating member.

6. The hand stamp of claim 5 wherein the frame comprises a cut-out therein sized and shaped to receive the locking tab of the operating member and to retain the locking tab such that the operating member is retained in a compressed position with respect to the frame upon depression of the operating member.

7. The hand stamp assembly of claim 6 wherein the cut-out of the frame includes a beveled face where the locking tab engages the cut-out to lock the operating member in the compressed position and the beveled face of the cut-out facilitates returning of the hand stamp to an uncompressed position upon removal of the storage cover.

8. A hand stamp assembly comprising;

a. a frame;

b. an operating member slidably mounted on the frame;

c. a spring disposed between the operating member and the frame to bias the operating member into an expanded non-stamping position;

d. a storage cover in which the frame is placed, disposed to engage a portion of the operating member upon depression of the operating member whereby a portion of the operating member becomes engaged with a portion of the frame such that the hand stamp is locked in a compressed position.

9. The hand stamp assembly of claim 8 further comprising a platen mounted on the operating member and an impression member secured to the platen, the impression member having indicia formed thereon to be stamped during use of the hand stamp assembly.

10. The hand stamp assembly of claim 9 further comprising means for releasing the operating member from engagement with the frame such that the hand stamp can be returned to an uncompressed non-stamping position.

* * * * *